US005689543A

United States Patent [19]

Graves et al.

[11] Patent Number: 5,689,543

[45] Date of Patent: Nov. 18, 1997

[54] METHOD FOR BALANCING ROTATABLE ANODES FOR X-RAY TUBES

[75] Inventors: Brian J. Graves, Waukesha; Thomas G. Ebben, Sullivan; Douglas J. Snyder, Brookfiled, all of Wis.

[73] Assignee: General Electric Company, Milwaukee, Wis.

[21] Appl. No.: 768,642

[22] Filed: Dec. 18, 1996

[51] Int. Cl.[6] ..... H01J 35/10

[52] U.S. Cl. ..... 378/144; 378/131

[58] Field of Search ..... 378/144, 143, 378/131, 132, 125, 119

[56] References Cited

U.S. PATENT DOCUMENTS

| | | |
|---|---|---|
| 3,851,204 | 11/1974 | Rollfinke . |
| 4,052,640 | 10/1977 | Hueschen et al. . |
| 4,132,916 | 1/1979 | Hueschen et al. . |
| 4,187,442 | 2/1980 | Hueschen et al. . |
| 4,272,696 | 6/1981 | Stroble et al. . |
| 4,276,493 | 6/1981 | Srinivasa et al. . |
| 4,393,511 | 7/1983 | Jens . |
| 4,481,655 | 11/1984 | Annis et al. . |
| 4,569,070 | 2/1986 | Schubert et al. . |
| 4,573,185 | 2/1986 | Lounsberry et al. . |
| 4,914,684 | 4/1990 | Upadhya . |
| 4,928,296 | 5/1990 | Kadambi . |
| 4,953,190 | 8/1990 | Kukoleck et al. . |
| 5,117,448 | 5/1992 | Penato et al. ..... 378/121 |
| 5,422,527 | 6/1995 | Lazzaro . |
| 5,461,659 | 10/1995 | Siemers et al. . |

OTHER PUBLICATIONS

Avallone et al., ed., Mark's Standard Handbook for Mechanical Engineers, 9 ed. (McGraw–Hill 1987).

Portion of Schenck Trebel Model H1/10B Hard Bearing Balancing Machine Manual (Schenck Trebel Corp., Deer Park, NY USA).

*Primary Examiner*—Don Wong

*Attorney, Agent, or Firm*—Dewitt Ross & Stevens; John H. Pilarski

[57] ABSTRACT

A method of balancing X-ray anodes wherein the anode rotor is dynamically balanced separately from the anode target, the anode target is then attached to the anode rotor to provide the assembled anode, and the assembled anode is then dynamically balanced. This sequential balancing method has the advantage that it results in an anode which remains balanced during operation at speeds up to and exceeding the anode's critical speeds, even though the dynamic balancing steps may be performed at speeds substantially below the anode's critical speeds. This is also convenient because at such low balancing speeds, the dynamic balancing steps can be performed in air rather than vacuum without concern for oxidation and spalling of the rotor bearings, excessive vibration, and potential safety concerns.

20 Claims, 1 Drawing Sheet

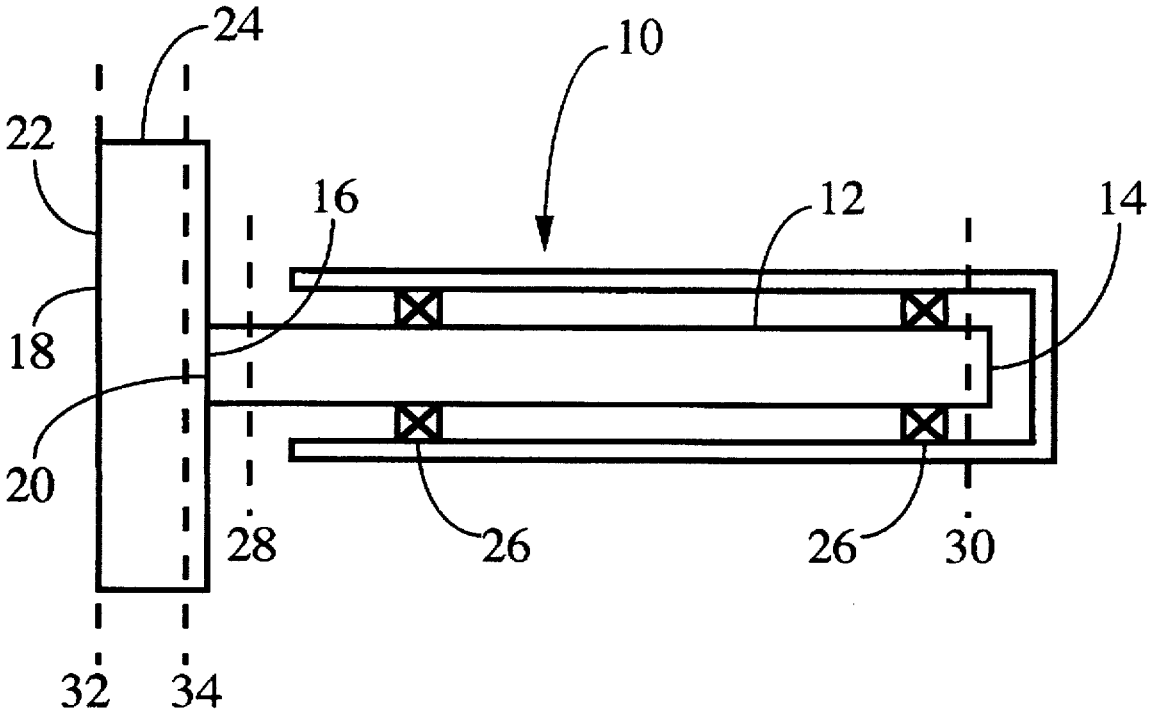
THE FIGURE

METHOD FOR BALANCING ROTATABLE ANODES FOR X-RAY TUBES

FIELD OF THE INVENTION

The invention relates generally to a method for precisely manufacturing X-ray anodes, and more specifically to a method of dynamically balancing such anodes about their rotational axes.

DESCRIPTION OF THE PRIOR ART

In X-ray machines and related apparata (e.g., computerized axial tomography scanners), X-ray photons are produced by directing a focused electron beam from a cathode to a rotating anode, more specifically, to the target area of the anode. The X-ray focal spot used to produce a diagnostic image is defined by the target's focal track, the area of electron beam impingement on the anode. Good descriptions of the general state of the art in X-ray tube structure and operation may be found in U.S. Pat. Nos. 3,851,204; 4,052,640; 4,132,916; 4,953,190; and 5,422,527.

To produce images free of artifacts and unwanted motion, a stable focal spot is critical. Stability of the spot is largely dependent on how well the anode is balanced about its rotational axis. If the anode is unbalanced, centrifugal force may cause the anode to deform during rotation, tilting the anode target about the plane perpendicular to the anode's rotational axis and causing the focal spot to jitter. Because the centrifugal force of the unbalance (and thus the amplitude of the tilt) varies with the square of the speed, this jitter increases at higher speeds. As speed further increases toward the anode's critical speed, i.e., any natural frequency within the anode assembly, the jitter can become especially pronounced.

Anode balance is also critical to the longevity of the X-ray tube assembly, as it will affect the wear on the bearings supporting the anode rotor. Bearing wear causes numerous problems, such as excess heating and thermal creep of the anode (resulting in focal spot drift); bearing/rotor spalling and drift of particles toward the cathode (resulting in arcing); and bearing rattle (causing additional focal spot jitter, as well as excess noise), among other problems. Good discussions of these and related problems can be found in U.S. Pat. Nos. 4,187,442; 4,272,696; 4,276,493; 4,393,511; 4,481,655; 4,569,070; 4,573,185; 4,914,684; 4,928,296; and 5,461,659.

Owing to the above considerations, anodes are generally dynamically balanced to a high degree of precision, typically to less than 0.25 gram-centimeter residual unbalance. Dynamic balancing is performed by rotating the anode at a speed substantially below the critical speed and using two correction planes to remove the unbalance. This dynamic balancing method is well known, and a concise explanation can be found, for example, in *Marks' Standard Handbook for Mechanical Engineers* (Availone et al., eds., 9th ed. 1987) at pp. 5–70 to 5–74. A wide variety of apparata are known to the art for effecting the method, and these apparata generally utilize means for detecting the angular position of the target (e.g., shaft encoders or electrical pickups) in conjunction with means for detecting the amplitude of the unbalance (e.g., force transducers or strobo-flashlights). Conveniently, there are commercially available dynamic balancing machines such as those made by the Schenck Trebel Corporation (Deer Park, N.Y., U.S.A.) which provide rapid and accurate output of these parameters at any user-selected correction planes. Once these parameters are known at the correction planes, appropriate amounts of material can be added or removed at the correction planes to remove the unbalance.

The dynamic balancing method described above generally served well in the past for anode balancing. However, several factors are making the method unsuitable for present use.

First, owing to the increase in X-ray output requirements in recent years, the anode targets of X-ray tubes are becoming larger and heavier, and the critical speeds of their anodes are thus decreasing. An additional complication arises in that anodes technically have several critical speeds of different types: the rigid critical speed, that is, the fundamental frequency of the overall anode as it behaves as a relatively rigid shaft; the flexible critical speeds, which may be described as the fundamental frequencies of the anode's subcomponents (e.g., the rotor, target, etc.) when deformation of the subcomponents (and interactions therebetween) come into play during rotation; and harmonics of the rigid and flexible critical speeds. Depending on the structure and material properties of the anode subcomponents, the lowest flexible critical speed can actually be lower than the lowest rigid critical speed.

Second, many newer X-ray applications require increased anode operating speeds. As a result, the gap between anode operating speeds and critical speeds has in many cases disappeared.

Third and most importantly, while the known dynamic balancing method works quite well to provide anodes which are balanced at low operating speeds, it does not account for balancing above the first flexible critical speed. As a result, most anodes currently in production are unstable at speeds at or near their first flexible critical speeds. Better balancing above the first flexible critical speed is typically obtained by repeatedly performing the dynamic balancing on the anode at a variety of speeds, wherein the highest speed approaches the operating speed of the anode. However, this process is time-consuming, difficult to perform, and potentially destructive. This is particularly true in view of the fact that the dry lubricated bearings supporting conventional anodes cannot rotate in air at operational speeds without rapidly oxidizing and spalling. Since the known dynamic balancing apparata are generally made to operate in air, rather than in the vacuum wherein the anode will operate when placed in service, it effectively becomes impossible to use the known dynamic balancing method near the anode's actual operating speed without destroying the anode.

There is thus a need in the art for methods of dynamically balancing X-ray anodes at low speeds under standard atmospheric conditions (i.e., in an oxidizing environment), wherein the resulting balanced anode remains dynamically balanced over a range of operating speeds up to and encompassing the flexible critical speed.

SUMMARY OF THE INVENTION

The present invention is directed to a method for balancing an X-ray anode as described in the claims set out at the end of this disclosure. To summarize, the preferred method includes the following steps. First, the anode rotor is dynamically balanced separately from the anode target in a first set of correction planes. Second, the anode is assembled by attaching the anode target to the rotor. Finally, the assembled anode is dynamically balanced in a second set of correction planes within the target. Thus, the dynamic balancing of the anode is done in stepwise fashion, first in the rotor and then in the overall anode. This is in distinction to the dynamic balancing method of the prior art, wherein only the overall anode is dynamically balanced, generally with one correction plane being chosen within the target and one within the rotor. The present method has several advantages over the prior art methods, including:

(1) The anodes balanced by the present method are balanced to a higher degree and over a greater range of operating speeds than anodes balanced by the methods of the prior art. The dynamic balancing steps of the present method can be performed at speeds substantially below the first critical speed of the anode, but the resulting anode is nevertheless balanced throughout a range of operating speeds up to and exceeding the first flexible critical speed.

(2) Because the dynamic balancing steps of the present method can be performed at speeds substantially below the first critical speed, the method may be performed in standard atmospheric conditions (i.e., in air), and no balancing apparata specially designed for vacuum operation are required.

Further advantages and features of the invention will be apparent from the following detailed description of the invention in conjunction with the associated drawings.

BRIEF DESCRIPTION OF THE DRAWINGS

The FIGURE is an elevational view of an X-ray robe anode.

DETAILED DESCRIPTION OF THE INVENTION

With reference to the FIGURE, which is provided to enhance the reader's understanding of the inventive method described herein, an anode representative of common X-ray tube assemblies known to the art is depicted at the reference numeral 10. The anode 10 includes a rotor 12 having a proximal end 14 and a distal end 16 whereupon a target 18 is attached. The target 18 includes a proximal face 20 whereupon the rotor 12 is attached and an opposing distal face 22 bounded by a target rim 24. The anode 10 is mounted within an X-ray tube with the rotor 12 supported by bearings 26. The rotor 12 is rotationally driven by electromechanical means while an electron beam impinges on the target 18 to emit X-ray photons from a focal spot.

The inventive method with which this disclosure is concerned initially takes the rotor 12, preferably already mounted within its bearings 26, and dynamically balances the rotor 12 by use of the known dynamic balancing method. More specifically, this is done by rotating the rotor 12 within its bearings 26 about its axis of rotation to detect the amplitude and angular position of rotor unbalance at two user-defined correction planes. These parameters may be determined by any known dynamic balance apparata, e.g., the Schenck Trebel Model H1/10B hard bearing balancing machine (Schenk Trebel Corp., Deer Park, N.Y., USA). To avoid bearing damage, the determination is preferably done at a speed substantially below the first critical speed of the anode 10 of which the rotor 12 will later be a part. Additionally, since commonly used balancing apparata provide unbalance measurements of higher accuracy when the correction planes are chosen farther apart, the correction planes are preferably spaced as distantly as possible on the rotor 12, e.g., near the opposing ends of the rotor 12 at the exemplary correction planes 28 and 30 illustrated in the FIGURE. When the magnitude and angular position of the unbalance at each of the correction planes 28 and 30 is detected, the requisite amounts of material to correct the rotor unbalance may be removed from the rotor 12 at each plane 28 and 30 by any appropriate means known to the art (e.g., milling and/or electron beam machining). Conversely, the requisite amounts of material may instead be added to correct the rotor unbalance. In order to preserve the integrity of the rotor balancing to the greatest possible extent, it is necessary that the rotor 12 not be removed from or shifted within the bearings 26 during removal or addition of material.

The target 18 is then attached to the distal end 16 of the rotor 12 to provide the assembled anode 10. (Again, as this is done, it is necessary that the rotor 12 is not removed from or shifted in position relative to the bearings 26.) The axis of rotation of the overall anode 10 will be the same as that of the rotor 12. The anode 10 is then rotated within the bearings 26, and the dynamic balance apparatus is used to detect the magnitude and angular position of unbalances within two user-defined correction planes within the anode 10. Preferably, these correction planes are located solely on the target 18, and are chosen to be spaced as far apart as possible from each other. As an example, the correction planes may be chosen on the opposing proximal and distal faces 20 and 22 of the target 18; however, for greater ease of removing or adding material to offset the detected unbalances, the correction planes are generally chosen at the distal face 22, i.e., at the correction plane 32, and additionally at a location on the target rim 24, e.g., at the correction plane 34. Again, the dynamic balancing is preferably done at a speed substantially lower than the first critical speed of the overall anode 10 to prevent the possibility of excessive vibration or wear to the bearings 26. Now that the effective mass of the rotor 12 has been increased by addition of the target 18, to further ensure that no unwanted vibration and/or bearing damage will occur during balancing, it may be preferable to balance the assembled anode 10 at a lower speed than that at which the rotor 12 alone was balanced. On the other hand, if the mass of the assembled anode 10 is sufficiently low that it is apparent that bearing wear and excessive vibration can be avoided, it may instead be preferable to balance the overall anode 10 at a higher speed, as this may potentially provide more accurate balancing.

In some cases, as where the target rim 24 is very narrow, it may not be feasible to choose two correction planes which both intersect the target 18 because they will be too closely spaced together and cannot be resolved as accurately by a balancing machine. In this case, two alternate measures are suggested. First, it may be desirable to situate one correction plane on the target 18 (e.g., at plane 32) and one on the rotor 12 (e.g., at plane 30). Second, three or more correction planes may be used, e.g., at all of planes 28, 30 and 32, though most commercial balancing equipment does not resolve unbalance at three planes simultaneously. The balancing obtained by either method is still superior to balancing obtained by any known prior art methods, particularly at speeds above the first flexible critical speed.

The balanced anode produced by the method described above is balanced to a substantially greater degree and over a wider range of operating speeds than anodes balanced by the prior art methods. Balanced anodes produced by the method described above will generally be readily identifiable because they will have four planes at which material has been added or removed to correct unbalance, for example, at two locations on the rotor and two locations on the target.

It is understood that preferred embodiments of the method have been described above in order to illustrate how to perform the method and obtain balanced anodes by use of the method. The invention is not intended to be limited to the described embodiments, and is intended to encompass all alternate embodiments that fall literally or equivalently within the scope of the claims set out below.

The invention claimed is:

1. A method for balancing a rotatable anode comprising the steps of:

a. dynamically balancing a rotor in a first set of correction planes at a first speed;

b. attaching a target to the rotor to provide the anode; and c. dynamically balancing the anode in a second set of correction planes at a second speed.

2. The method of claim 1 wherein the second set of correction planes consists of correction planes located within the target.

3. The method of claim 1 wherein the first and second speeds are below the first critical speed of the anode.

4. The method of claim 1 wherein the first and second speeds are substantially the same.

5. The method of claim 1 wherein the step of dynamically balancing the rotor comprises the substeps of:

a. rotating the rotor about an axis of rotation;

b. detecting unbalance of the rotor within the first set of correction planes;

c. adding or removing material from the rotor within each correction plane of the first set of correction planes, the amount of material added or removed in each plane being sufficient to substantially reduce the unbalance therein.

6. The method of claim 1 wherein the step of dynamically balancing the anode comprises the substeps of:

a. rotating the anode about an axis of rotation;

b. detecting unbalance of the anode within the second set of correction planes;

c. adding or removing material from the anode within each correction plane of the second set of correction planes, the amount of material added or removed in each plane being sufficient to substantially reduce the unbalance therein.

7. The method of claim 6 wherein the second set of correction planes intersects the target.

8. The method of claim 1 wherein the rotor includes a distal end whereupon the target is attached, an opposing proximal end, and a midpoint located equidistantly from the distal and proximal ends, and further wherein the first set of correction planes includes correction planes located on opposite sides of the midpoint.

9. The method of claim 1 wherein the target includes a proximal face from which the rotor extends and an opposing distal face bounded by a target rim, and further wherein the second set of correction planes includes one correction plane intersecting the distal face and one correction plane intersecting the target rim.

10. A balanced anode comprising a rotor being dynamically balanced in a first set of correction planes at a first speed and a target attached to the rotor in the manner to dynamically balance the anode in a second set of correction planes at a second speed.

11. A method of balancing a rotatable anode comprising the steps of:

a. providing a rotor and a separate target, the rotor and target being attachable to define the anode;

b. rotating the rotor about an axis of rotation at a first speed;

c. detecting unbalance of the rotor at a first pair of correction planes intersecting the rotor;

d. removing material from the rotor at the first pair of correction planes to dynamically balance the rotor;

e. attaching the target to the rotor to provide the anode.

12. The method of claim 11 wherein the first speed is below the first critical speed of the anode.

13. The method of claim 11 further comprising the steps of:

a. rotating the anode about the axis of rotation at a second speed;

b. detecting unbalance of the anode at a second pair of correction planes; and c. removing material from the target at the second pair of correction planes to dynamically balance the anode.

14. The method of claim 13 wherein the target includes a proximal face from which the rotor extends and an opposing distal face bounded by a target rim, and further wherein the second pair of correction planes includes one correction plane intersecting the distal face and one correction plane intersecting the target rim.

15. The method of claim 13 wherein the second speed is below the first critical speed of the anode.

16. The method of claim 13 wherein the first and second speeds are substantially the same.

17. The method of claim 11 wherein the rotor includes a distal end whereupon the target is attached, an opposing proximal end, and a midpoint located equidistantly from the distal and proximal ends, and further wherein the first pair of correction planes includes correction planes located on opposing sides of the midpoint.

18. A balanced anode comprising a rotor and a target; wherein the rotor is dynamically balanced in a first set of correction planes at a first speed by removing material from the rotor before being attached to the target.

19. A method for balancing a rotatable anode comprising the steps of:

a. providing a rotor and a separate target, the rotor and the target being attachable to define the anode;

b. rotating the rotor about an axis of rotation at a first speed below the first critical speed of the anode, and simultaneously detecting unbalance of the rotor at a first pair of correction planes intersecting the rotor;

c. adding or removing material from the rotor at the first pair of correction planes to dynamically balance the rotor;

d. attaching the target to the rotor to provide the anode;

e. rotating the anode about the axis of rotation at a second speed below the first critical speed of the anode, and simultaneously detecting unbalance of the anode at a second pair of correction planes intersecting the target; and f. adding or removing material from the target at the second pair of correction planes to dynamically balance the anode.

20. A balanced anode comprising a rotor being dynamically balanced in a first pair of correction planes at a first speed below a first critical speed of the anode by adding or removing material from the rotor and a target attached to the rotor in the manner to dynamically balance at a second speed below the first critical speed in a second pair of correction planes by adding or removing material from the target.

* * * * *